US005752569A

United States Patent [19]

Bhavsar et al.

[11] Patent Number: 5,752,569

[45] Date of Patent: May 19, 1998

[54] FLOW TUBE FOR USE IN AN EQUALIZING SUBSURFACE SAFETY VALVE

[75] Inventors: Rashmi B. Bhavsar, Houston; Alan G. Schroeder, Pearland; Thomas G. Hill, Jr., Kingwood, all of Tex.

[73] Assignee: Camco International, Inc., Houston, Tex.

[21] Appl. No.: 598,483

[22] Filed: Feb. 8, 1996

Related U.S. Application Data

[63] Continuation-in-part of Ser. No. 303,489, Sep. 9, 1994, Pat. No. 5,503,229.

[51] Int. Cl.[6] ..... E21B 34/12

[52] U.S. Cl. ..... 166/324; 166/332.7

[58] Field of Search ..... 166/324, 332.7, 166/332.8; 137/629, 630.16

[56] References Cited

U.S. PATENT DOCUMENTS

| | | | |
|---|---|---|---|
| 3,078,923 | 2/1963 | Tausch . | |
| 4,161,219 | 7/1979 | Pringle . | |
| 4,415,036 | 11/1983 | Carmody et al. . | |
| 4,427,071 | 1/1984 | Carmody . | |
| 4,452,311 | 6/1984 | Speegle et al. | 137/629 X |
| 4,457,376 | 7/1984 | Carmody et al. . | |
| 4,478,286 | 10/1984 | Fineberg . | |
| 4,629,002 | 12/1986 | Pringle . | |
| 4,703,805 | 11/1987 | Morris . | |
| 4,722,399 | 2/1988 | Pringle . | |
| 5,058,682 | 10/1991 | Pringle . | |
| 5,503,229 | 4/1996 | Hill, Jr. et al. | 166/332.7 |

*Primary Examiner*—William P. Neuder

*Attorney, Agent, or Firm*—Tobor & Goldstein, LLP

[57] ABSTRACT

An equalizing subsurface safety valve for controlling fluid flow in a well conduit comprises a tubular body member having a longitudinal bore extending therethrough, a flapper hingably connected within the tubular body member to alternately permit and prevent fluid flow through the longitudinal bore, means for biasing the flapper to a normally closed position to prevent fluid flow through the longitudinal bore, a flow tube longitudinally movable within the longitudinal bore for controllably opening the flapper, fluid passage formed within the tubular body for providing fluid communication between the longitudinal bore adjacent a first side of the flapper and a second side of the flapper, and a closure member mounted across the fluid passage adjacent the first side of the flapper and movable along an axis generally transverse to the longitudinal bore. A side wall of the flow tube includes a first notch so that the closure member is maintained in a closed position when the flow tube is in a retracted position and the closure member is moved to an open position when the flow tube is moved to open the flapper. A second notch can be included in the flow tube so that the closure member will return to a closed position when the flow tube is extended to a position where the flapper is opened.

10 Claims, 6 Drawing Sheets

FLOW TUBE FOR USE IN AN EQUALIZING SUBSURFACE SAFETY VALVE

This application is a Continuation in part of U.S. patent application Ser. No. 08/303,489, filed Sep. 9, 1994 now U.S. Pat. No. 5,503,229.

BACKGROUND OF THE INVENTION

1. Field of the Invention

The present invention relates to a subsurface safety valve used for controlling fluid flow in a well conduit and, more particularly, to an equalizing subsurface safety valve.

2. Description of Related Art

Subsurface safety valves are commonly used in wells to prevent uncontrolled fluid flow through the well in the event of an emergency, such as to prevent a well blowout. Conventional safety valves use a flapper which is biased by a spring to a normally closed position, but is retained in an open position by the application of hydraulic fluid from the earth's surface. A typical subsurface safety valve is shown and described in U.S. Pat. No. 4,161,219, which is commonly assigned hereto.

When the flapper is in the closed position, well fluid pressure below the flapper acting upon relatively large surface area of flapper makes the opening of the flapper difficult. This difficulty in opening cannot be easily overcome simply by increasing the force exerted against the flapper because the relatively small cross-sectional area of the opening piston and cylinder assembly would require a fluid pressure that may burst the control line carrying the hydraulic fluid. To overcome the difficulty in opening the flapper, different forms of mechanisms have been developed to allow the pressure above and below the flapper to equalize prior to the complete opening of the flapper. These types of safety valves are generally referred to as "equalizing" safety valves.

U.S. Pat. No. 3,078,923, which is commonly assigned hereto, discloses a through-the-side wall equalizing valve mechanism which is opened by the downward movement of the flow tube prior to the flow tube contacting and opening the flapper. While the initial fluid flow is beneficially directed across the equalizing valve mechanism to keep the flapper's sealing surface undamaged, the equalizing valve mechanism is subject to the same relatively rapid fluid flow which will erode its valve sealing surface. Again, any damage to any sealing surface must be avoided for the safety valve to be fully functional in order to protect the well. Additionally, if the spring that holds the valve mechanism in place becomes damaged or lost, the valve mechanism may become off-center or simply fall out of its seat. Then, the safety valve would be non-functional because an uncontrolled opening would be created which could not prevent the well fluid from flowing therepast.

U.S. Pat. Nos. 4,427,071 and 4,457,376 each disclose an equalizing mechanism which consists of a flapper with an inclined upper surface. When the flow tube is extended to open the flapper, the lower edge of the flow tube contacts the inclined surface to cause the flapper to partially unseat the flapper prior to it being fully opened. While this equalizing mechanism does not have the spring retention problem mentioned above, it still has the problem of the initial fluid flow damaging the primary sealing surface of the flapper.

U.S. Pat. Nos. 4,415,036 and 4,478,286 each disclose an equaling mechanism which consists of a plug valve held by a spring across a vertical opening in the flapper itself. While the plug valve in U.S. ''286 does not have the problem of the initial fluid flow eroding a sealing surface, both plug valves shown in these patents must be held by a spring that can be damaged or simply fall off due to the actions of corrosive fluids over a long period of time. Again, if the spring is lost, the plug valve will fall out of its opening in the flapper. Then, the safety valve would be non-functional because an uncontrolled opening would be created which could not prevent the well fluid from flowing therepast.

U.S. Pat. Nos. 4,629,002, 4,703,805, 4,722,399 and 5,058,682, all of which are commonly assigned hereto, each disclose equalizing mechanisms which do not address the problems of erosion of the primary sealing surface and of spring retention. Each of these patents disclose fluid flow diverting arrangements, generally referred to as labyrinth passages, to slow the initial fluid flow to prevent sealing surface erosion. In spite of these safety valves' performance benefits, these safety valves require complex machining operations and numerous parts which add significantly to their costs of manufacture.

There is a need for an equalizing safety valve which can be relatively inexpensively manufactured, and which does not suffer the problems of primary and equalizing sealing surface erosion and of spring retention.

SUMMARY OF THE INVENTION

The present invention has been contemplated to overcome the foregoing deficiencies and meet the above described needs. Specifically, the present invention is an equalizing subsurface safety valve for controlling fluid flow in a well conduit having a tubular body member with a longitudinal bore extending therethrough, and a flapper hingably connected within the tubular body member to alternately permit and prevent fluid flow through the longitudinal bore. The flapper is biased to a normally closed position by a spring. A flow tube is disposed to be longitudinally movable within the longitudinal bore for controllably opening the flapper. A fluid passage is formed within the tubular body for providing fluid communication between the longitudinal bore adjacent a first side of the flapper and a second side of the flapper. A closure member, such as a plug, is mounted across the fluid passage adjacent the first side of the flapper and is movable along an axis generally transverse to the longitudinal bore. A side wall of the flow tube a first notch so that the closure member is maintained in a closed position when the flow tube is in a retracted position and the closure member is moved to an open position when the flow tube is moved to open the flapper. A second notch can be included in the flow tube so that the closure member will return to a closed position when the flow tube is extended to a position where the flapper is fully opened.

DETAILED DESCRIPTION OF THE PREFERRED EMBODIMENTS

For the purposes of the following discussion, it will be assumed that the present invention is installed within a subsurface safety valve of the type shown in U.S. Pat. No. 4,161,219, which are commonly referred to as rod-piston safety valves. However, it should be understood that the present invention can be used in any commercially available safety valve, be they tubing conveyed, wireline conveyed, hydraulically operated, and electrically operated.

Figure 1:
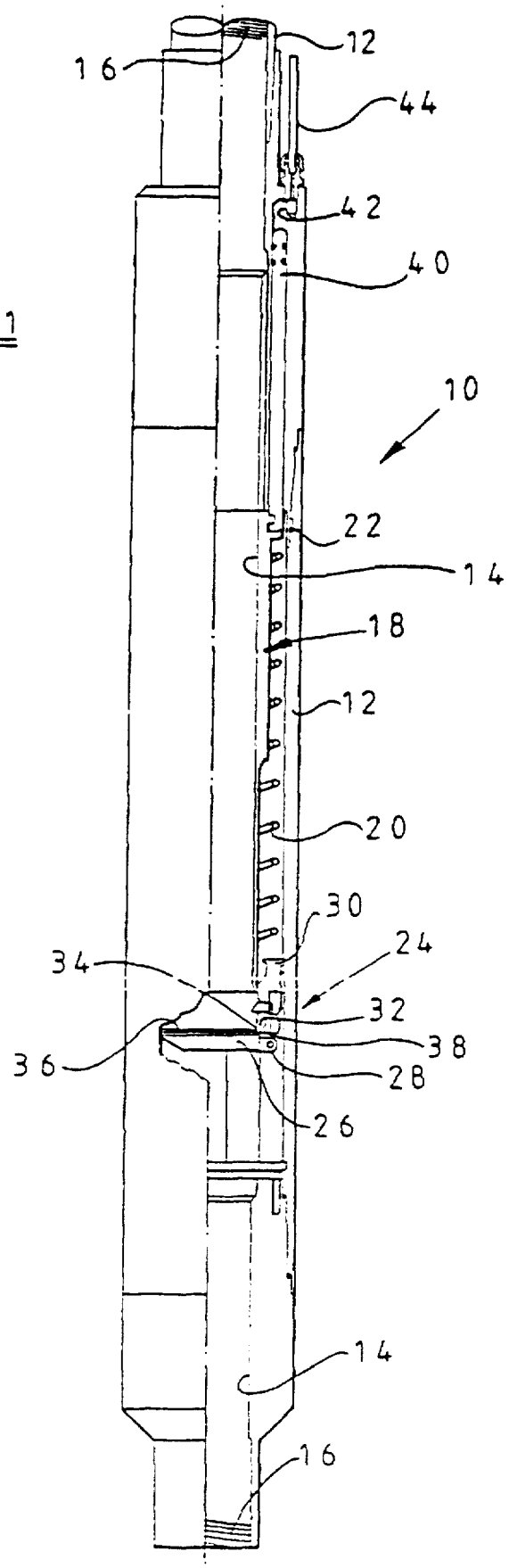
FIG. 1 is an elevational side view, partially in cross-section, showing a subsurface safety valve of the present invention.

Referring to FIG. 1, a subsurface safety valve 10 of the present invention is comprised of a generally tubular body 12 with a longitudinal bore 14 that extends therethrough. Each end of the body 12 includes mechanisms, such as threads 16, for interconnection with a pipe string (not shown) suspended within a wellbore. A sleeve member 18, usually referred to as a flow tube, is disposed within the bore 14 and is adapted for axial movement therein. The flow tube 18 includes a spring 20 disposed therearound that acts upon a shoulder 22 on the flow tube 18 to bias the flow tube 18 away from a flapper mechanism 24.

The flapper mechanism 24 generally comprises a disc or flapper valve closure member 26 with spaced arms 28 on a peripheral edge thereof that are hingably connected to an annular housing 30 mounted within the bore 18. The annular housing 30 includes a metallic annular sealing surface 32 cooperable with an annular sealing surface 34 on the flapper 26. Further, the annular housing 30 includes a secondary annular sealing surface 38 formed from an annular body of pliable material, which is cooperable with the annular sealing surface 34 on the flapper 26. The metallic sealing surface 32 is generally referred to as the "hard seat" and the pliable sealing surface 38 is generally referred to as the "soft seat".

A rod-piston system is provided to open the flapper 26, and is comprised of a piston 40 sealably mounted for reciprocal movement within a bore 42 located within the wall of the tubular body 12. A first end of the piston 40 is in contact with hydraulic fluid provided thereto from the earth's surface through a relatively small diameter control conduit 44. A second end of the piston 40 is operatively connected to the flow tube 18. When the pressure of hydraulic fluid in the control conduit 44 exceeds the force needed to compress the spring 20, the piston 40 moves to move the flow tube 18 into contact with the flapper 26 and thereby open same. In the event that the hydraulic pressure applied to the piston 40 is decreased, as by command from the earth's surface or by the control conduit 44 being damaged, the spring 20 moves the flow tube 18 away from the flapper 26. The flapper 26 then is rotated into a closed position by action of a hinge spring (not shown) to permit the annular seats 34, 36 and 38 to mate to provide a fluid seal to prevent fluid flow therepast.

As has been described above, when the flapper 26 has been closed the pressure of fluids within the bore 14 upstream of (ie. below) the closed flapper 26 increases while the pressure of the wellbore fluids downstream of (ie. above) the closed flapper 26 decreases while such wellbore fluids are recovered to the earth's surface through the pipe string. This pressure differential has made the subsequent opening of the flapper 26 difficult because the relatively small diameter control conduit 44 must provide sufficient fluid force to overcome the spring 20 as well as to move the flapper 26 against the fluid pressure therebelow to break the fluidic seal. The equalizing mechanism of the present invention permits the controlled opening of the flapper 26 in a manner that permits the fluid pressure below the flapper 26 to be reduced to thereby reduce the force necessary to open the flapper 26. More importantly, the equalizing mechanism of the present invention prevents the initial relatively high velocity flow of fluids past the flapper 26 from damaging the annular sealing surfaces 34, 36 and 38.

The equalizing mechanism of the present invention is best shown in FIGS. 2–5 wherein it is shown that the annular housing 30 includes a recess 46 and an annular bore seal 48 on an exterior surface thereof. Wellbore fluids from below the flapper 26 flow past a series of baffles or grooves 50, located on an exterior surface of the housing 30 and which are designed to slow the flow of fluids therepast, and through an opening 52 into an annular space 54 formed by the recess 46. The wellbore fluids are prevented from entering the bore 14 above the flapper 26 by action of the annular bore seal 48.

The annular housing 30 includes a generally radial bore 56 that, if unrestricted, permits fluid communication between the bore 14 above the flapper 26 and the annular space 54 and the bore 14 below the flapper 26. The bore 56 is shown as being essentially tangential to the longitudinal axis of the bore 14; however, the bore 56 can be angled in almost any direction as is desired. A tubular valve member or plug 58 is disposed for reciprocal movement within the bore 56, and includes an enlarged shoulder 60 on a first end thereof which extends into the annular space 54, and a beveled or curved portion 62 on an opposite second end thereof which extends partially into the bore 14. The enlarged shoulder 60 includes a metallic annular sealing surface 64 that cooperates with an annular sealing surface or valve seat assembly 66 on the annular housing 30 about the bore 56, as will be described in more detail below.

Figure 5:
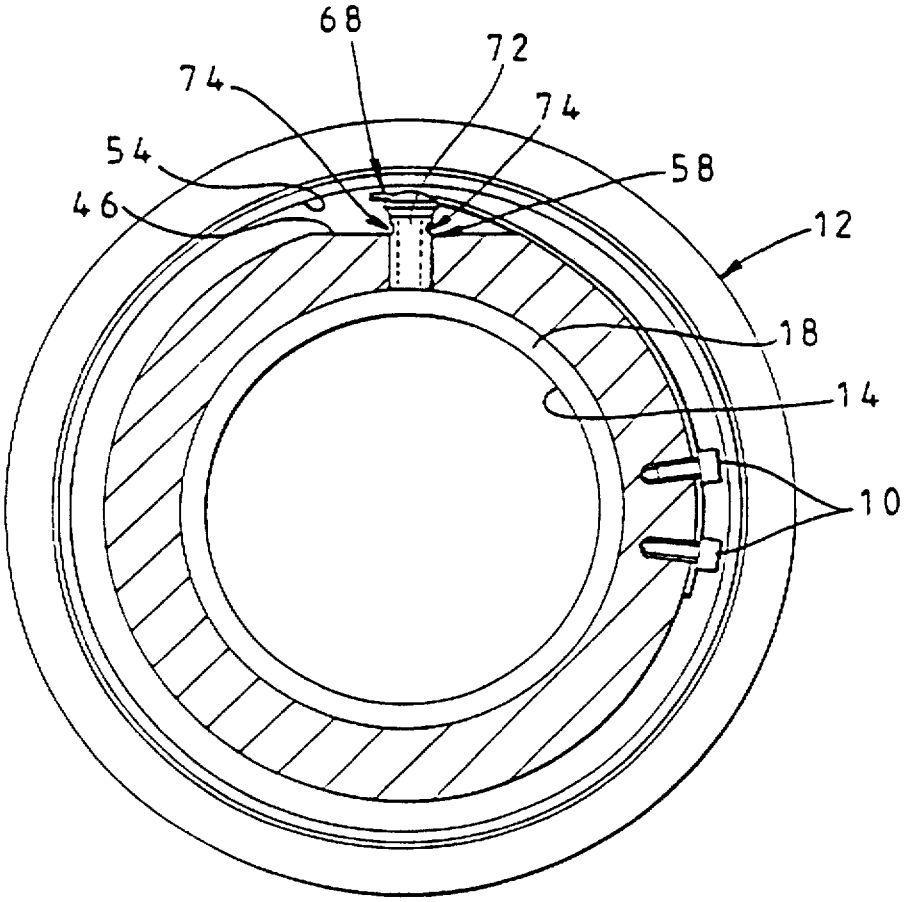
FIG. 5 is a sectional view taken along Line A—A of FIG. 4.

As shown in FIG. 5, the valve member 58 is held in a normally closed position by action of a circumferential spring 68 which is fastened to the annular housing 30 by way of screws 70. In the event that the spring 68 becomes damaged or fails, the valve member 58 cannot become lost within the wellbore because the valve member 58 will be retained within the annular space 54 about the annular housing 30. Further, if the spring 68 fails, the valve member 58 is designed to be forced into a closed position by action of the fluid pressure against the relatively large surface area of the shoulder 60.

The valve member 58 includes a generally longitudinal opening 72 which extends from the beveled portion 62 and is in communication with one or more generally tangential openings 74 that exit the valve member 58 at a location between the second end thereof and the sealing surface 64. The purpose of these openings 72 and 74 will be described below.

Figure 2:
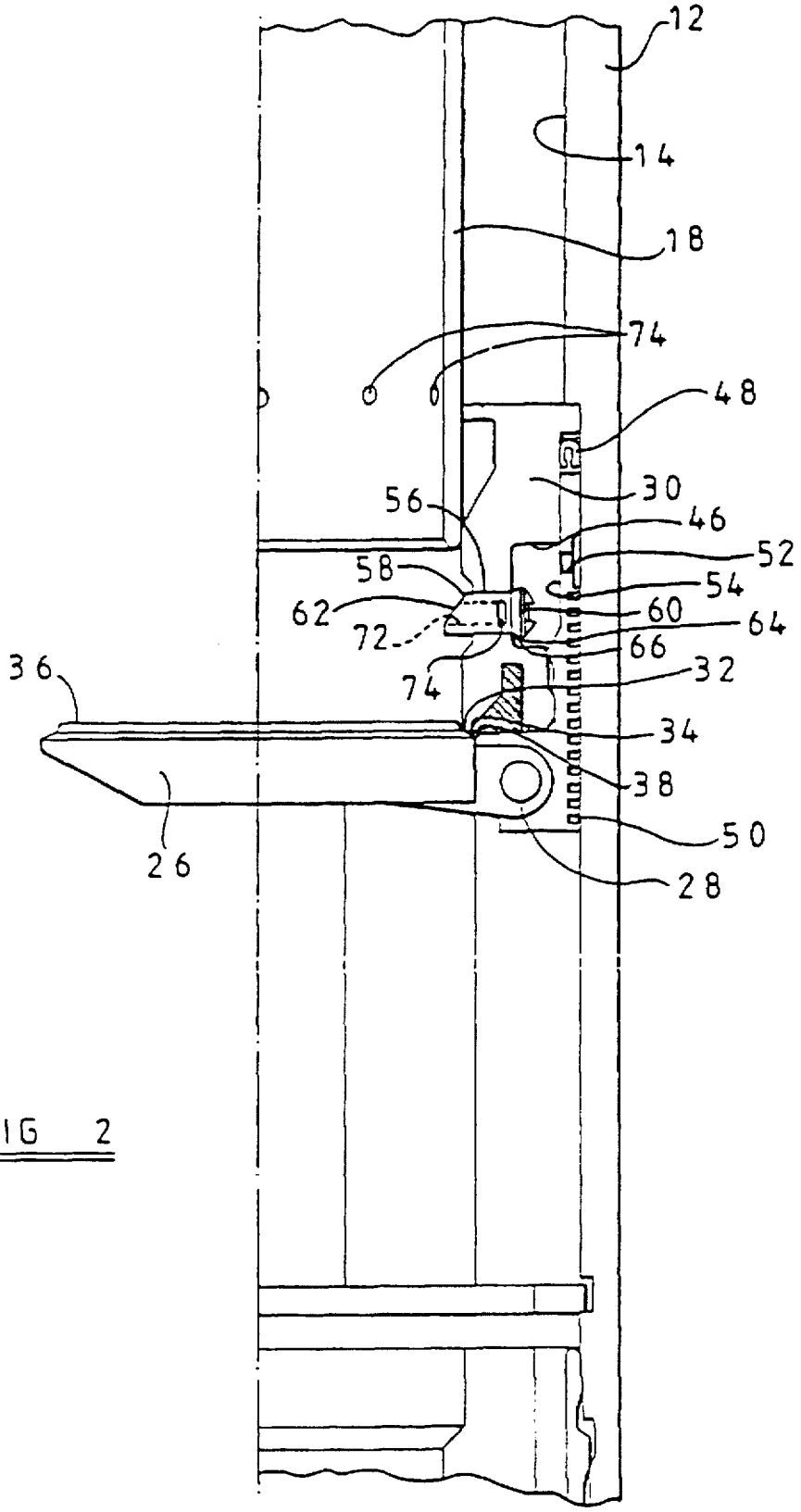
FIG. 2 is a fragmentary elevational view showing an equalizing mechanism of the present invention installed within a subsurface safety valve of FIG. 1 and shown in the closed position.
Figure 3:
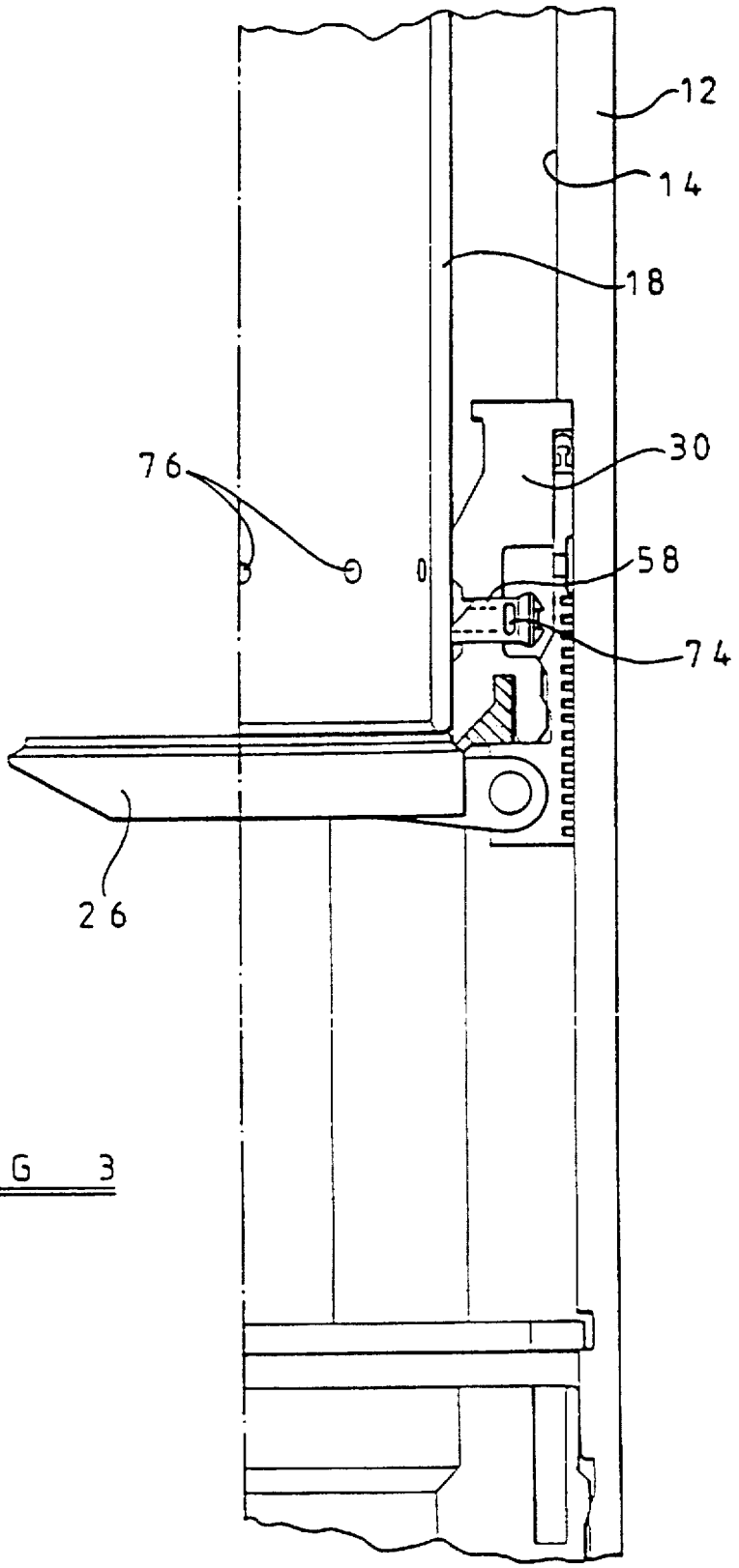
FIG. 3 is a view similar to FIG. 2 with the equalizing mechanism of the present invention shown in the equalizing position.

As shown in FIG. 2, the flapper 26 and the valve member 58 are in the closed position to prevent any fluid flow therepast. When the flapper 26 is to be opened, the flow tube 18 is forced towards the flapper 26 by the application of hydraulic fluid through the control conduit 44 (as has been described previously) or by electrical/mechanical action or simply mechanical action, depending upon the type of safety valve within which the present invention is included. As shown in FIG. 3, the second end of the valve member with the beveled end 62 extends into the bore 14. A lower portion of the flow tube 18 comes into contact with such beveled end 62 and causes same to be moved radially outward. The lower portion of the flow tube 18 is formed from material sufficiently hard to not be deformed or galled by contract with the beveled end 62, or a lower portion of the flow tube 18 can include a surface hard coating, as will be described in detail below, or be formed as a separate piece joined thereto and formed from harder material than the other portions of the flow tube 18. The flow tube 18 preferably includes means to keep the valve member 58 always in the closed position, except when the flow tube 18 is moving, as will be described in detail below.

When the valve member 58 is moved radially by contact with the flow tube 18, the annular sealing surfaces 64 and 66 are parted, then the valve member 58 is further moved radially to expose the one or more tangential openings 74. The relatively high pressure wellbore fluid then rapidly flows thereinto and out from the longitudinal opening 72 and into the bore 18 above the flapper 26. Since the tangential openings 74 are displaced from the annular sealing surfaces 64 and 66, the relatively rapid flow of wellbore fluids will not damage same. Additionally, the lower portion of the flow tube 18 includes one or more radial openings 76 to assist in the flow of wellbore fluids into the bore 14 by way of the interior longitudinal bore of the flow tube 18. Otherwise, the gap between the interior surface of the annular housing 30 and an exterior surface of the flow tube 18 may not be sufficiently large enough to permit the rapid equalization needed for efficient operation of the safety valve 10.

Figure 4:
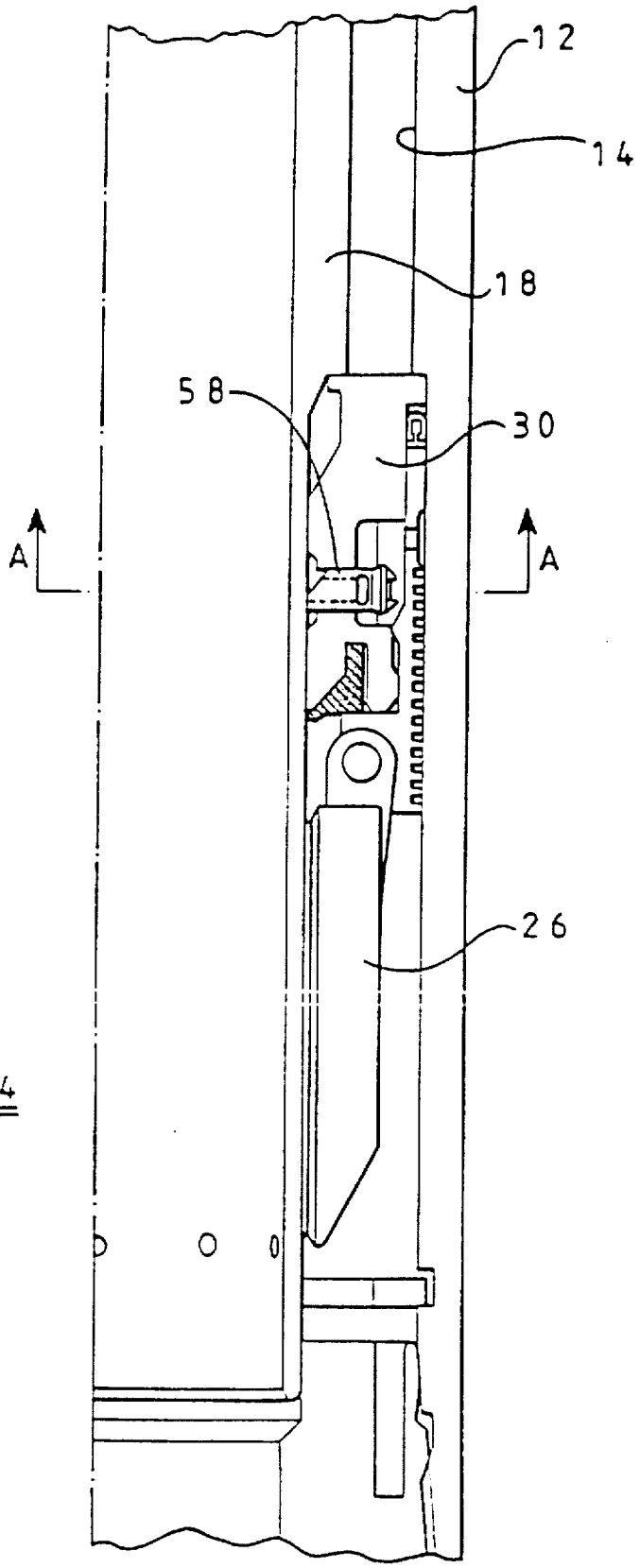
FIG. 4 is a view similar to FIG. 2 with the equalizing mechanism of the present invention shown in the open position.

The operator at the earth's surface can stop the movement of the flow tube 18 until the pressure equalization has occurred and then proceed with the opening of the flapper 26 (ie. a two-step process), or the flow tube 18 can be moved in a single continuous movement to open the flapper 26. In either case, the flow tube 18 is forced against the flapper 26 with sufficient force to overcome the hinge spring (not shown) and holds the flapper 26 in the open position, as shown in FIG. 4, as long as the hydraulic pressure from the control conduit 44 is applied. When the hydraulic pressure from the control conduit 44 is reduced or removed, the spring 20 causes the flow tube 18 to be moved away from the flapper 26, so that: (a) the flapper 26 rotates to a closed position and the sealing surfaces 34, 36 and 38 come into operative contact with each other to prevent fluid flow therepast, and (b) the flow tube 18 moves away from the beveled end 62 of the valve member 58 and the tangential opening 74 is moved into recess within the annular housing 30 and the sealing surfaces 64 and 66 come into operative contact with each other to prevent fluid flow therepast.

Figure 6:
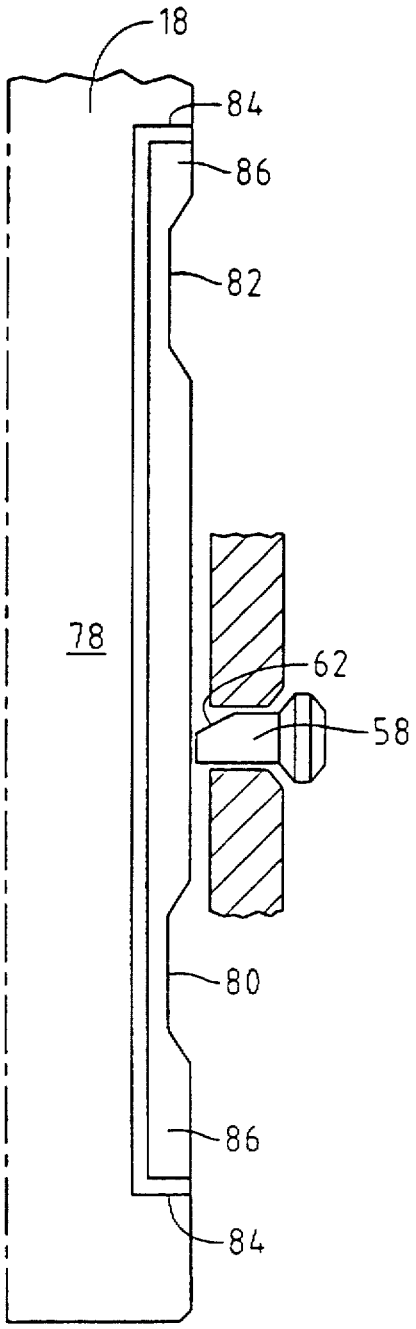
FIG. 6 is an elevational side view of a side wall of the flow tube of the present invention.

In one preferred embodiment of the present invention, the flow tube 18 includes features that cooperate with the beveled end 62 of the valve member 58 to ensure that equalizing fluid flow is permitted and then restricted only at certain locations of the flow tube 18 within the longitudinal bore 14. As shown in FIG. 6, a side wall 78 of the flow tube 18 includes a first notch or recess 80 and a second notch or recess 82. The first notch 80 and the second notch 82 are spaced from each other and longitudinally aligned to cooperate with the beveled end 62 of the valve member 58. Specifically, as described previously, the beveled end 62 of valve member 58 extends into the longitudinal bore 14 when the valve member 58 is in the sealing or closed position. When the flow tube 18 is in the "retracted" or the most upward position and the flapper is closed, the beveled end 62 is received into the first notch 80. The first notch 80 is sized and has a depth sufficient to permit the valve member 58 to move radially outwardly and into its "closed" position where fluids are prevented from passing through the equalizing bore 56.

When the flapper 26 is to be opened, the flow tube 18 is caused to move downwardly, whereby the inclined surface of the first notch 80 pushes the beveled end 62 outwardly to an "open" position to permit fluids to escape from below the flapper 26 and through the bore 56 before the flapper 26 is opened. The beveled end 62 rides along the outside surface of the side wall 78 of the flow tube 18 while the flow tube is in transit from its retracted position to its "extended" position when the flapper 26 is fully opened. It is preferred that once the flow tube 18 has moved downwardly to open the flapper 26 that the valve member 58 be returned to a closed position where fluids are prevented from passing through the bore 56. To accomplish this closing, the second notch 82 is provided on the flow tube 18 above the first notch 80, whereby the beveled end 62 is received into the second notch 82, and is of sufficient depth to permit the valve member 58 to move radially towards the flow tube 18 and into the fully closed position.

Since the beveled end 62 rides along the side wall 78 of the flow tube 18 there is a chance that some galling or abrasion can occur on the side wall 78. The tolerances are close enough within the safety valve 10 that any such galling can degrade the safety valve's ability to function properly. To prevent possible galling, the side wall 78 of the flow tube 18 includes a strip of surface hardening material 84 along the path that the beveled end 62 traverses. This material 84 can be cobalt-based alloys, and most preferably STELLITE. In cases where galling may not be a concern but friction may be a concern, the side wall 78 of the flow tube 18 can include a strip of friction reducing material 86 along the path that the beveled end 62 traverses. This material 86 can be any number of polymeric materials, and preferably a fluorocarbon, such as TEFLON. Most preferably, the strip includes an inner layer of the hardening material 84 which is overlaid with an outer layer of the friction reducing material 86.

As has been described in detail above, the present invention has been contemplated to overcome the deficiencies of the prior equalizing safety valves specifically by preventing its equalization mechanism from being lost downhole and from being damaged by an initial flow of fluid when the flapper is opened.

Whereas the present invention has been described in relation to the drawings attached hereto, it should be understood that other and further modifications, apart from those shown or suggested herein, may be made within the scope and spirit of the present invention.

What is claimed is:

1. A valve opening mechanism for use within a subsurface safety valve, comprising:

a flow tube adapted for movement within a longitudinal bore extending through a tubular body of the safety valve;

a first end of the flow tube adapted to controllably open a normally closed flapper to permit fluid flow through the longitudinal bore;

a side wall of the flow tube including a first notch for receiving a first end of an equalizing closure member that extends into the longitudinal bore when the equalizing closure member is in a closed position, so that the closure member is maintained in a closed position when the flow tube is in a retracted position and the closure member is moved to an open position when the flow tube is moved to open the flapper, the equalizing closure member having a longitudinal opening extending from the first end and at least one tangential opening disposed in fluid communication with the longitudinal opening to establish an internal passageway within the equalizing closure member through which fluid may flow when the equalizing closure member is in its open position;

an outer surface of the flow tube including a surface hardening material across an area thereof contacted by the first end of the closure member; and an outer surface of the surface hardening material including an outer coating of a friction reducing material.

2. A valve opening mechanism of claim 1 wherein the side wall of the flow tube includes a second notch for receiving thereinto the first end of the equalizing closure member, so that the closure member will return to a closed position when the flow tube is extended to a position where the flapper is opened.

3. A valve opening mechanism of claim 2 wherein the first notch and the second notch are longitudinally aligned.

4. A valve opening mechanism of claim 1 wherein the friction reducing material is a fluorocarbon.

5. An equalizing subsurface safety valve for controlling fluid flow in a well conduit, comprising:

a tubular body member having a longitudinal bore extending therethrough;

a flapper hingably connected within the tubular body member to alternately permit and prevent fluid flow through the longitudinal bore;

means for biasing the flapper to a normally closed position to prevent fluid flow through the longitudinal bore;

a flow tube longitudinally movable within the longitudinal bore for controllably opening the flapper;

fluid passage formed within the tubular body for providing fluid communication between the longitudinal bore adjacent a first side of the flapper and a second side of the flapper;

a closure member mounted across the fluid passage adjacent the first side of the flapper and movable along an axis generally transverse to the longitudinal bore;

a side wall of the flow tube including a first notch for receiving a first end of an equalizing closure member that extends into the longitudinal bore when the equalizing closure member is in a closed position, so that the closure member is maintained in a closed position when the flow tube is in a retracted position and the closure member is moved to an open position when the flow tube is moved to open the flapper, the equalizing closure member having a longitudinal opening extending from the first end and at least one tangential opening disposed in fluid communication with the longitudinal opening to establish an internal passageway within the equalizing closure member through which fluid may flow when the equalizing closure member is in its open position;

an outer surface of the flow tube including a surface hardening material across an area thereof contacted by the first end of the closure member; and an outer surface of the surface hardening material including an outer coating of a friction reducing material.

6. An equalizing subsurface safety valve of claim 5 wherein the side wall of the flow tube includes a second notch for receiving thereinto the first end of the closure member, so that the closure member will return to a closed position when the flow tube is extended to a position where the flapper is opened.

7. An equalizing subsurface safety valve of claim 6 wherein the first notch and the second notch are longitudinally aligned.

8. A valve opening mechanism of claim 5 wherein the friction reducing material is a fluorocarbon.

9. An equalizing subsurface safety valve of claim 5 wherein the valve closure member further comprises a generally cylindrical plug having an enlarged annular sealing surface adjacent a second end thereof for cooperable sealing engagement with a sealing surface formed within the tubular body.

10. An equalizing subsurface safety valve of claim 9 wherein the second end of the generally cylindrical plug being beveled to assist in its displacement upon operable contact with the flow tube.

* * * * *